United States Patent [19]

Pasques

[11] Patent Number: 4,515,379

[45] Date of Patent: May 7, 1985

[54] WHEEL TRUCK AND ROLLER ASSEMBLY

[76] Inventor: Christian Pasques, P.O. Box 5397, Santa Monica, Calif. 90405

[21] Appl. No.: 520,545

[22] Filed: Aug. 5, 1983

[51] Int. Cl.[3] ..... A63C 17/26

[52] U.S. Cl. ..... 280/11.27; 280/87.04 A

[58] Field of Search ..... 280/11.28, 87.04 A, 280/11.27, 767, 11.19; 180/907; 16/46, 47, 48, DIG. 27

[56] References Cited

U.S. PATENT DOCUMENTS

| | | | |
|---|---|---|---|
| 2,790,649 | 4/1957 | Lubbe | 16/48 |
| 3,399,904 | 9/1968 | Schinke | 280/87.04 A |
| 4,047,727 | 9/1977 | Holladay | 280/11.28 |

OTHER PUBLICATIONS

Advertisement "The Coper" from Skate Boarder Magazine, vol. 5, No. 6, Jan. 1979.

*Primary Examiner*—David M. Mitchell
*Assistant Examiner*—Richard Camby
*Attorney, Agent, or Firm*—Ralph B. Pastoriza

[57] ABSTRACT

The wheel truck for a skateboard or a rollerskate includes a roller coaxially mounted between the left and right skate wheels. This roller is of a lesser radius than the radius of the skate wheels so that it will normally be clear of objects when the wheels are rolling on a flat terrain. However, the roller will engage objects such as a curb edge extending upwardly between the wheels a distance greater that the difference between the radii of the roller and wheels and roll over such objects to thereby minimize loss of momentum of a skater.

6 Claims, 2 Drawing Figures

WHEEL TRUCK AND ROLLER ASSEMBLY

FIELD OF THE INVENTION

This invention relates generally to skateboards and rollerskates and more particularly to an improved skate wheel truck and roller assembly.

BACKGROUND OF THE INVENTION

Truck assemblies for skateboards and rollerskates usually comprise an axle housing secured to the underside of the skateboard platform or rollerskate frame. This housing supports an axle in turn carrying left and right skate wheels usually independently mounted for rotation about the axle.

When a skater passes over uneven terrain or over a curb or the like, objects or edge portions of the curb projecting upwardly between the left and right wheels can engage the axle housing. Such engagement at its maximum can seriously damage the housing and at its minimum simply slow down the skater or decrease his momentum because of the frictional drag.

BRIEF DESCRIPTION OF THE PRESENT INVENTION

The present invention comtemplates the provision of a wheel truck and roller assembly for use with either a skateboard or rollerskates which overcomes the foregoing problem.

More particularly, in its broadest aspect the present invention includes left and right skate wheels, a roller, and means for mounting the skate wheels and roller in coaxial alignment with the roller between the skate wheels and wherein the roller can rotate independently of the skate wheels.

In the preferred embodiment of the invention, the roller has a smaller radius than the skate wheels so that it will normally clear objects when a person is skating on level terrain. On the other hand, the roller will engage objects extending upwardly between the wheels a distance greater that the difference between the radii of the roller and wheels and will roll over such objects to thereby minimize loss of momentum of a skater traveling over uneven terrain wherein such objects might otherwise damage the axle housing and decrease a skater's momentum.

BRIEF DESCRIPTION OF THE DRAWINGS

A better understanding of the this invention will be had be referring to the accompanying drawings in which.

DETAILED DESCRIPTION OF THE PREFERRED EMBODIMENT

Figure 1:
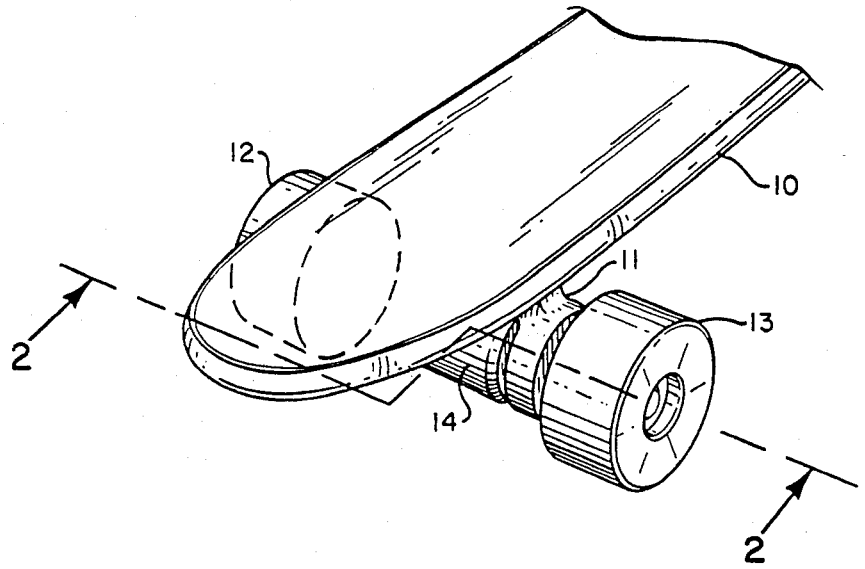
FIG. 1 is a fragmentary perspective view of a skateboard incorporating the wheel truck and roller assembly of the present invention; and, FIG. 2 is a fragmentary cross section looking in the direction of the arrows 2—2 of FIG. 1.

Referring first to FIG. 1, there is shown a typical skateboard platform 10 to the underside of which there is secured an axle housing 11. As will become clearer as the description proceeds, axle housing 11 rotatably supports an axle for left and right skate wheels 12 and 13.

In accord with the present invention there is also provided a roller 14 coaxially mounted between the left and right skate wheels 12 and 13.

Figure 2:
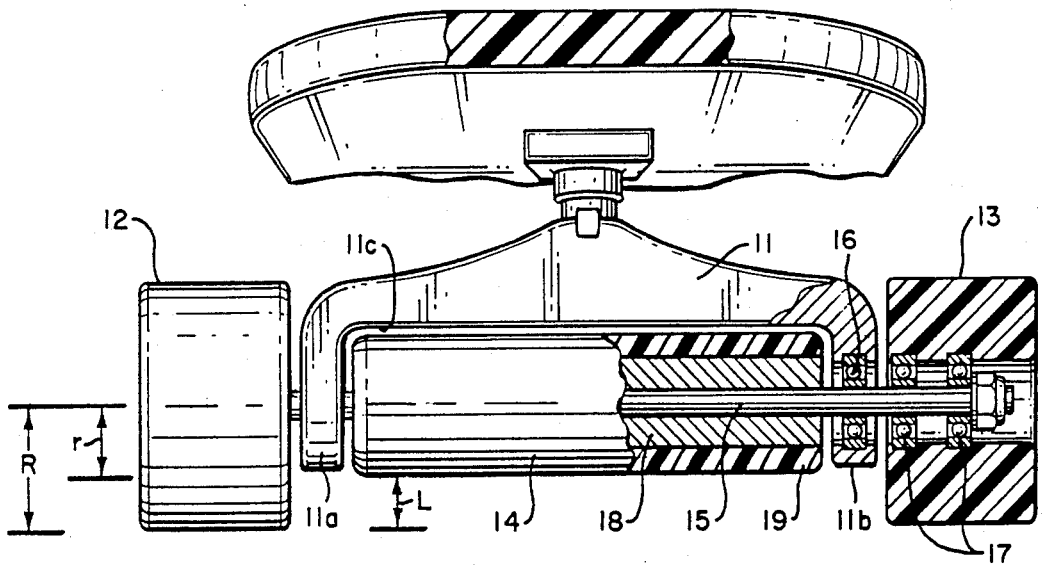

Referring now to the detailed showing in FIG. 2, the axle housing 11 itself has left and right legs 11*a* and 11*b* defining therebetween an open channel 11*c*. An axle 15 passes through the legs and across the channel as shown. Axle housing bearings such as shown at 16 in the legs 11*a* and 11*b* support the axle 15 for rotation relative to the housing 11.

The referred to left and right skate wheels 12 and 13 are shown in FIG. 2 receiving the opposite end portions of the axle 15 extending from the left and right legs 11*a* and 11*b* respectively of the axle housing. Appropriate wheel bearings such as indicated at 17 rotatably mounted the wheels to the end portions of the axle.

The assembly is completed by the provision of the single elongated roller 14 described in FIG. 1 surrounding in coaxial relationship the portion of the axle within the channel 11*c*. This roller, in the preferred embodiment, includes an inner tubular core 18 of metal surrounding the axle and secured thereto, and an outer tubular portion 19 of plastic material secured to the tubular core of metal. This outer core preferably comprises polyurethane.

The radius of the roller 14 is designated r to the left in FIG. 2 and this radius is less than the radius R of the wheels. As a consequence, there is left a clearance as indicated by the letter L between the roller 14 and level terrain. The roller will normally therefore be clear of objects when the wheels are rolling on a flat terrain. However, the roller will engage objects extending upwardly between the wheels a distance greater than the differance between the radii of the roller and the wheels; that is, the distance L. Upon engagement of such objects by the roller, the roller will roll over the objects thereby minimizing the loss of momentum of a skater traveling over uneven terrain. In the absence of such a roller, such objects might otherwise damage the axle housing and decrease a skater's momentum.

From all of the foregoing, it will now be evident that the present invention has provided a novel wheel truck and roller assembly for skateboards and rollerskates. Changes falling within the scope and spirit of this invention will occur to those skilled in the art. The wheel truck and roller assembly is therefore not to be thought of as limited to the specific embodiment set forth merely for illustrative purposes.

I claim:

1. A wheel truck and roller assember for a skate platform including:

(a) an axle housing secured to the underside of said platform, said axle housing having left and right legs defining an open channel between the legs;

(b) an axle passing through the legs and across the channel;

(c) left and right skate wheels;

(d) a roller; and (e) means for mounting said skate wheels and roller in coaxial alignment with the roller between the skate wheels in said open channel and the skate wheels receiving the opposite end portions of the axle extending from the left and right legs respectively of said axle housing, and wherein the roller can rotate independently of the skate wheels.

2. A wheel truck and roller assembly for a skate platform, including:

(a) an axle support for securement to the underside of said platform, said axle support having left and right legs defining an open channel between the legs;

(b) an axle held in said support in a manner to expose opposite end portions of the axle outside said legs and a central portion of the axle between the legs; and (c) skate wheels mounted on said opposite end portions of said axle and a central roller mounted on the central portion of the axle, the central roller having a radius less than the radius of the wheels.

3. An assembly according to claim 2, in which said wheels are rotatably mounted on the opposite end portions of the axle, said roller being secured to the central portion of the axle, and said axle being rotatably mounted to said axle support so as to be free to rotate independently of the wheels.

4. A wheel truck and roller assembly including, a combination:

(a) a skate platform;

(b) an axle housing secured to the underside of said platform, said axle housing having left and right legs defining an open channel between the legs;

(c) an axle passing through the legs and across the channel;

(d) axle housing bearings in the legs supporting said axle for rotation relative to the housing;

(e) left and right skate wheels receiving the opposite end portions of the axle extending from the left and right legs respectively of said axle housing;

(f) wheel bearings rotatably mounting said wheels to said end portions of said axle; and (g) a single elongated roller surrounding in coaxial relationship the portion of said axle within said channel, said roller having a radius less than the radius of the wheels so that the roller will normally be clear of objects when the wheels are rolling on a flat terrain, said roller engaging objects extending upwardly between the wheels a distance greater that the difference between the radii of the roller and wheels and rolling over such objects to thereby minimize loss of momentum of a skater traveling over uneven terrain wherein such objects might otherwise damage the axle housing and decrease a skater's momentum.

5. An assembly according to claim 4, in which said roller includes an inner tubular core of metal surrounding said axle and secured thereto, and an outer tubular portion of plastic material secured to said tubular core of metal.

6. An assembly according to claim 5, in which said plastic material is polyurethane.

* * * * *